US006447231B1

(12) United States Patent
Omahony

(10) Patent No.: US 6,447,231 B1
(45) Date of Patent: Sep. 10, 2002

(54) CLAMPING DEVICE

(76) Inventor: Cornelius Omahony, 19 Muldowney Court, Malahide, Dublin (IE)

( * ) Notice: Subject to any disclaimer, the term of this patent is extended or adjusted under 35 U.S.C. 154(b) by 0 days.

(21) Appl. No.: 09/561,915

(22) Filed: May 1, 2000

(51) Int. Cl.[7] ..... B42B 5/08

(52) U.S. Cl. ..... 412/38; 412/33; 412/36; 412/43; 83/934

(58) Field of Search ..... 412/33, 36, 38, 412/43; 83/934

(56) References Cited

U.S. PATENT DOCUMENTS 4,906,157 A * 3/1990 Todaro et al. ..... 412/38
5,273,387 A * 12/1993 Groswith, III et al. ..... 412/38
5,431,519 A * 7/1995 Baumann ..... 412/38
5,454,679 A * 10/1995 Whiteman ..... 412/38
5,740,712 A * 4/1998 Watkins et al. ..... 83/549
6,059,504 A * 5/2000 Ishida et al. ..... 412/38
6,074,151 A * 6/2000 Pas ..... 412/38
6,079,924 A * 6/2000 Chiang ..... 412/38
6,206,070 B1 * 3/2001 Salmon ..... 156/513
6,210,092 B1 * 4/2001 Von Rohrscheidt ..... 412/38

* cited by examiner

*Primary Examiner*—A. L. Wellington
*Assistant Examiner*—Mark T. Henderson

(57) ABSTRACT

The subject invention is an improved paper clamping and insertion device. The clamping device comprises of two members connected by an elastic material where each member together with the elastic material can fit through a hole punched by the insertion device or any other standard paper punch. The insertion device consists of a U shaped upper support structure housing a punch and lower support structure housing a magazine of clamping devices. Operation of the insertion device will result in the punch descending and punching the paper sheets. After the punch has penetrated the sheets it then engages one of the clamping devices legs and withdraws it through the punched hole simultaneously the second leg of the clamping device is separated from the magazine and is positioned on the underside of the sheets. Further upward movement of the punch releases the top leg of the clamping device, which in turn is positioned by the elastic member to securely hold the papers between the two legs.

11 Claims, 8 Drawing Sheets

SECTION 2-2

CLAMPING DEVICE

BACKGROUND OF INVENTION

This invention relates to a device for clamping and insertion of clamps for restraining two or more pieces of paper. Many such clamping devices exist, such as the paper clip, staple and various forms of clamping usually of a metallic form. The currently available paperclip consists of a piece of spring wire, which is double bent to form an outer loop and an inner loop. The spring effect of the torsion caused by separating the inner and outer loop grips the papers. The spring clip is only effective for holding a small range of sheets, is not secure as papers can become detached and the clip looses its effectiveness after repeated use. The staple presently in common use which is punched through the paper with a stapler is only effective for a limited range of sheets with one staple size. When it is required to remove staples this can prove difficult and may require a special extractor. When larger thicknesses of paper are required to be joined large heavy stapled are required which are extremely difficult to remove. After removal of the heavier staple the sheets tend to adhere to one another due to the piercing action of the staple leg. This causes a problem when automatic feeding to a copying machine of papers that have been pierced by a large staple. The metallic clamp, which clamps sheets from the outer edge, is large and cumbersome requires different clamps for different thicknesses. The production cost of the metallic clamp is also relatively high.

OBJECTS AND ADVANTAGES

It is the objective of the invention to provide an improved paper clamping device to be used manually or by use of a device for insetting the improved paper clamping device, and another objective of the said invention is to provide an improved device for clamping sheets varying in quantity from two to any thickness encountered in normal office use. Another objective is to provide an improved device that enables the previously clamped papers to be easily opened and subsequently closed manually. It is also an object of this invention to provide an improved paper clamping and insertion device.

Other and further objects of the subject invention will become apparent from reading the following description taken in conjunction with the claims.

DRAWINGS

Figure 1:
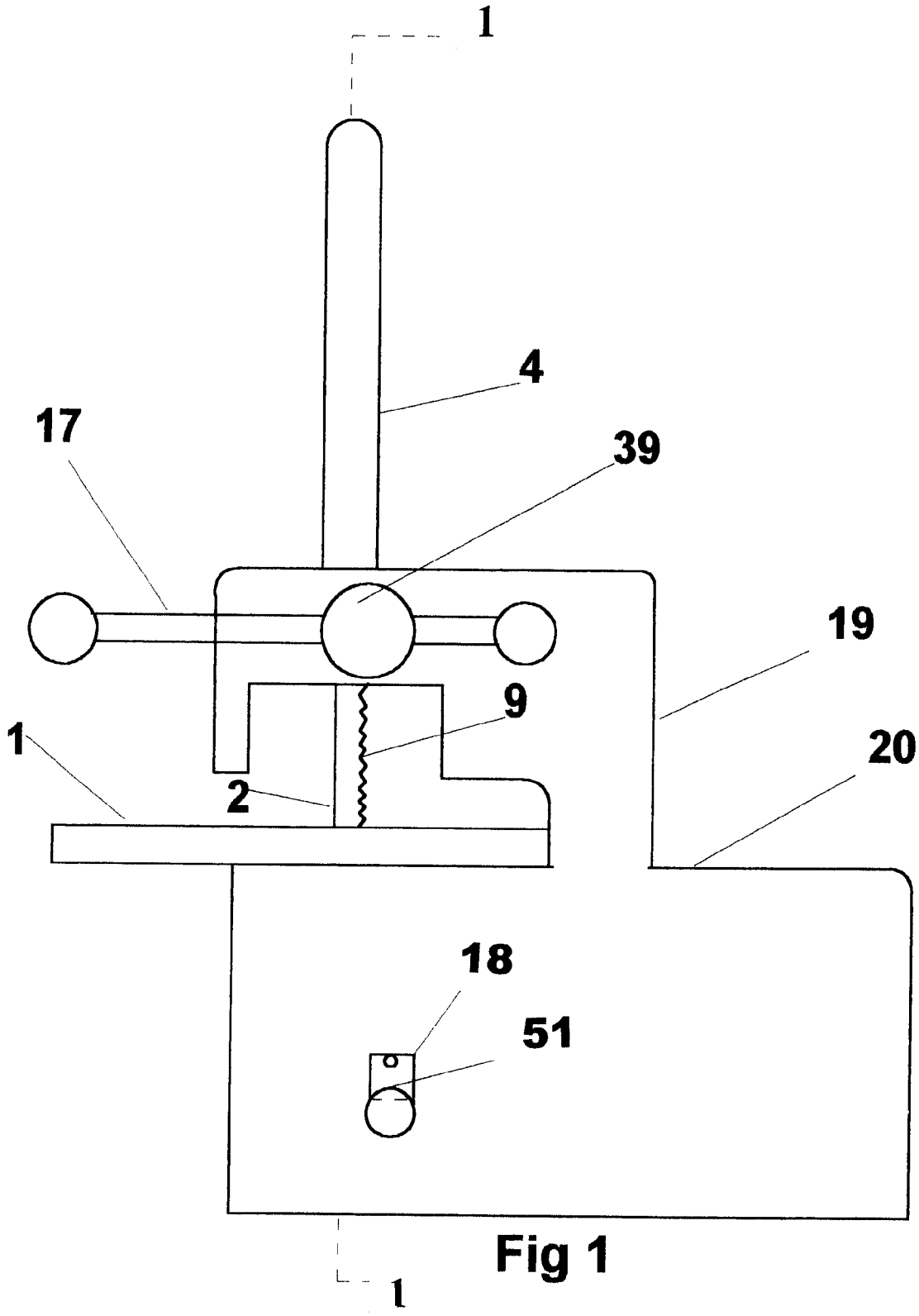

FIG. 1 sheet 1 shows a side view of the subject invention.

Figure 2:
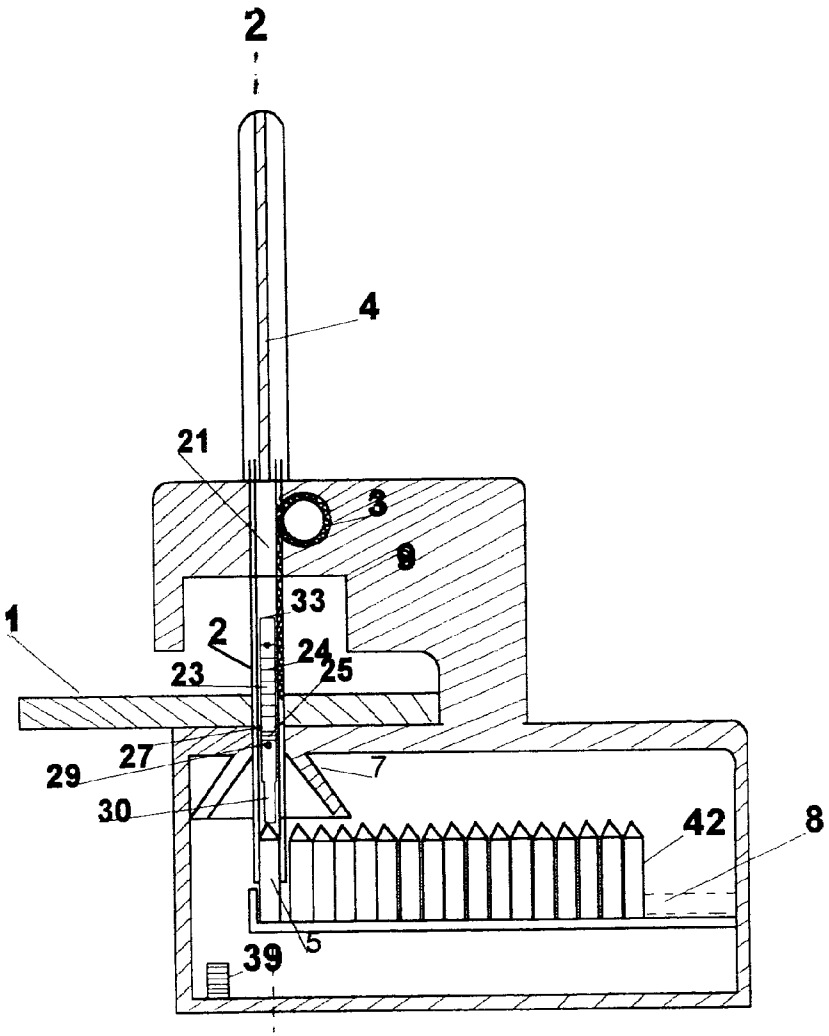

FIG. 2 sheet 2 is a side section of FIG. 1 showing insertion device and clamping device as the punch engages on the clamping device.

Figure 3:
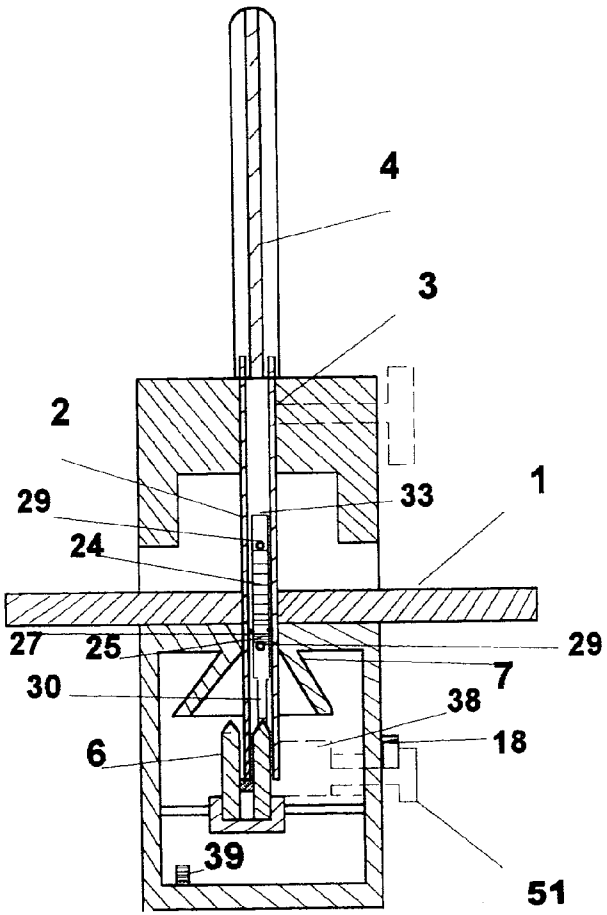

FIG. 3 sheet 2 shows an end section view of FIG. 1 taken on centre of punch as it engages on the clamping device.

Figure 4:
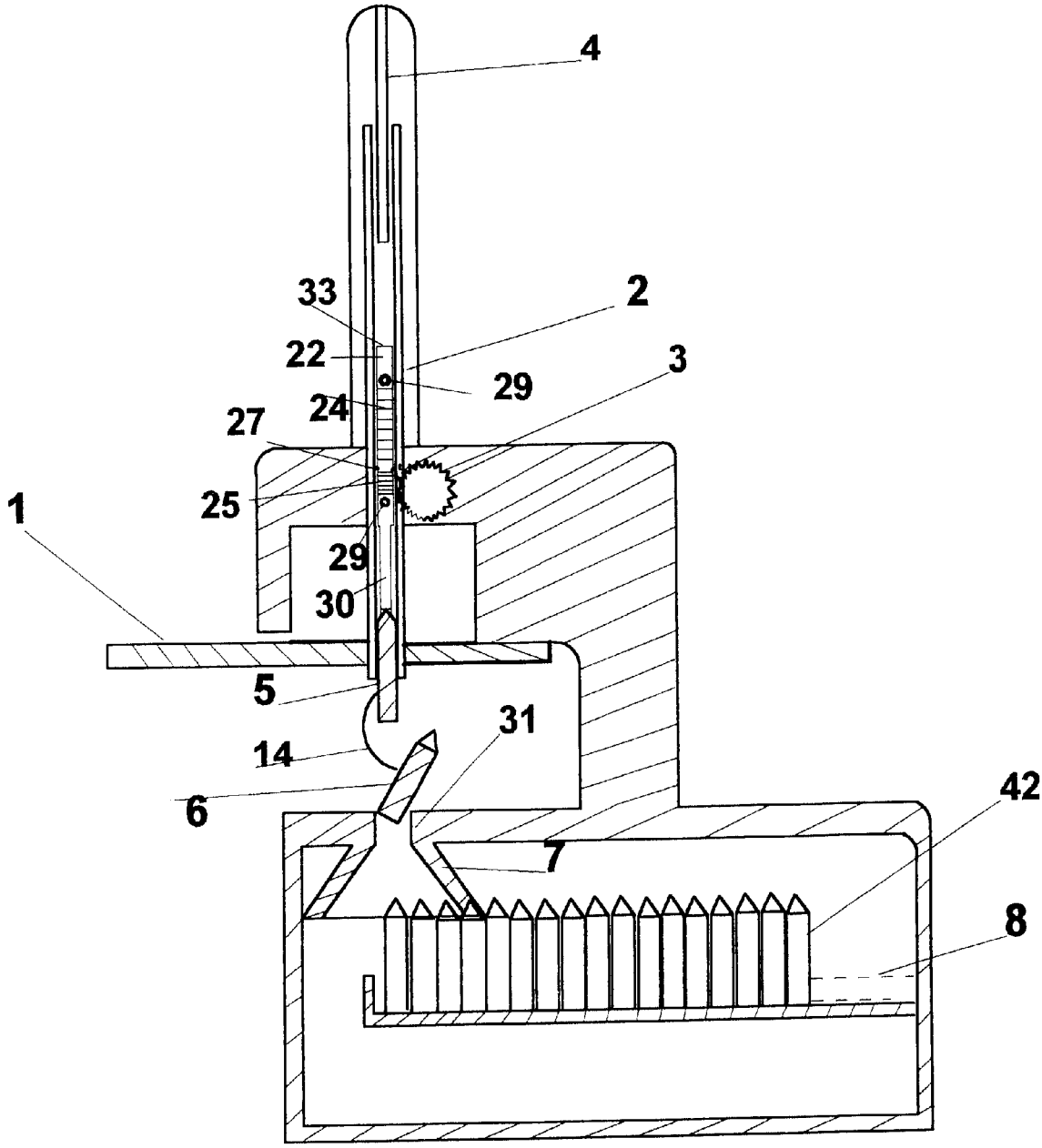

FIG. 4 sheet 3 shows side section view of insertion device after it has withdrawn clamping device through the punch hole and has raised the punched paper.

Figure 5:
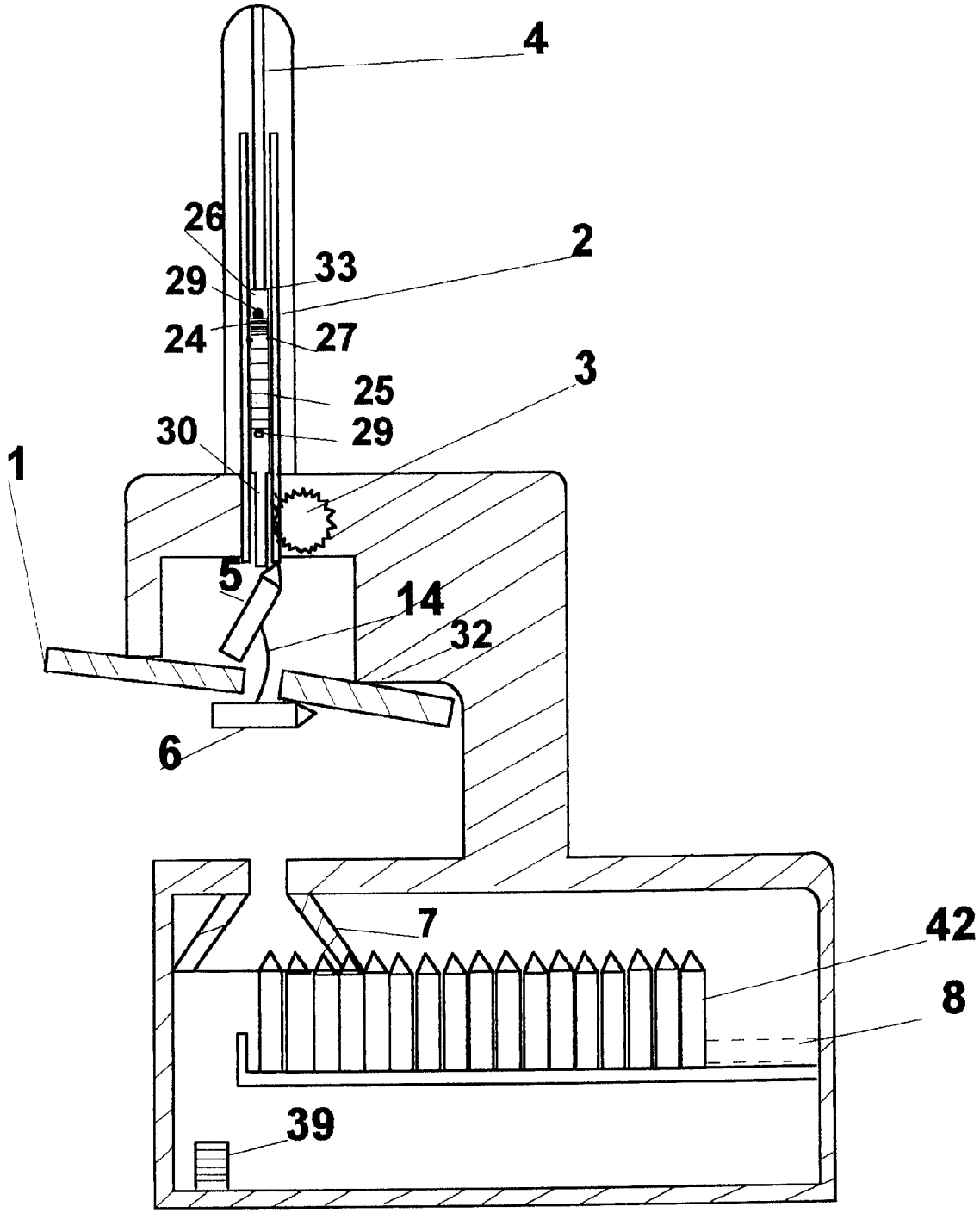

FIG. 5 sheet 4 shows side section of the upper clamping device leg after it has been released by the punch.

Figure 6:
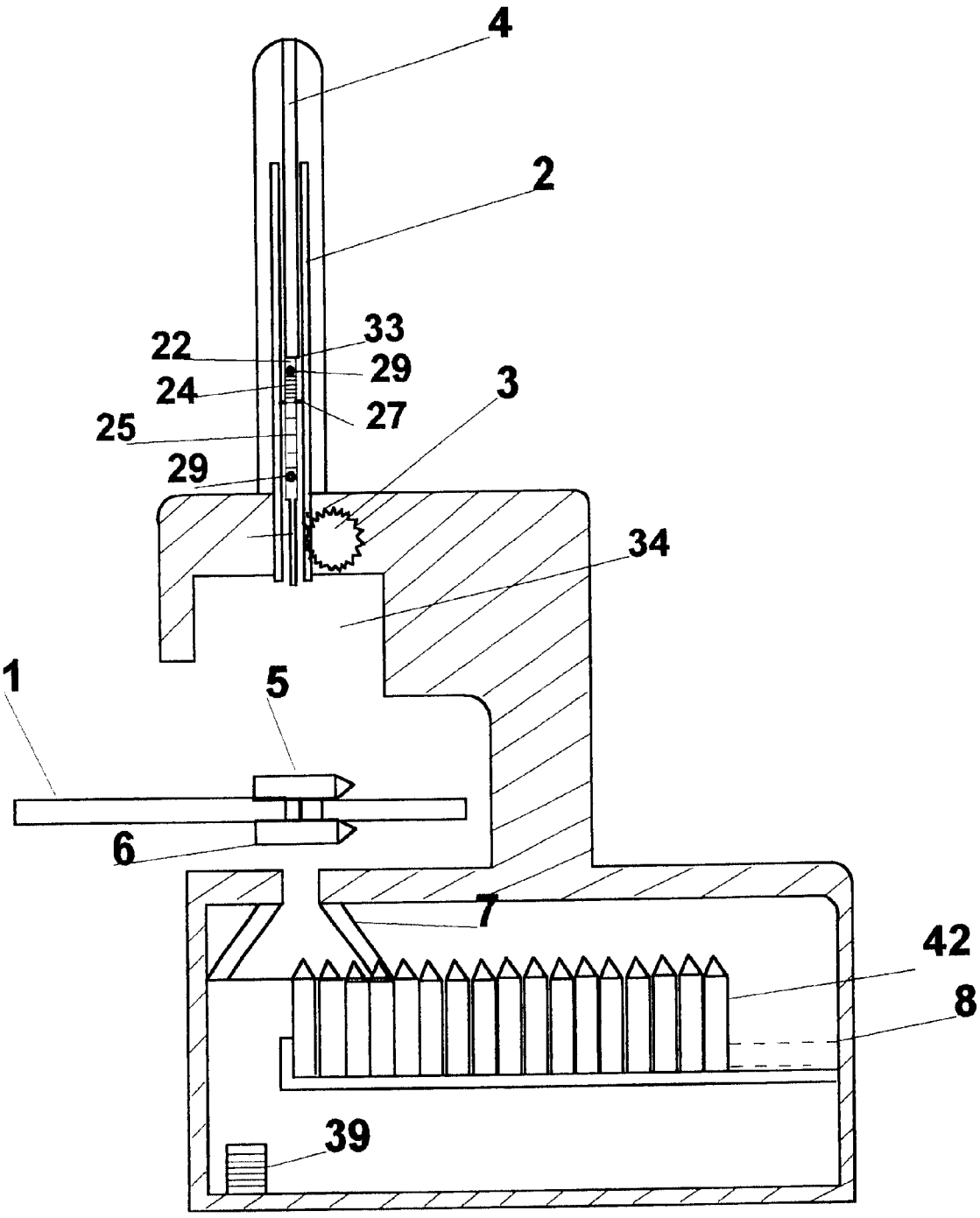

FIG. 6 sheet 5 shows the paper clamped by upper and lower legs of clamping device.

Figure 7A:
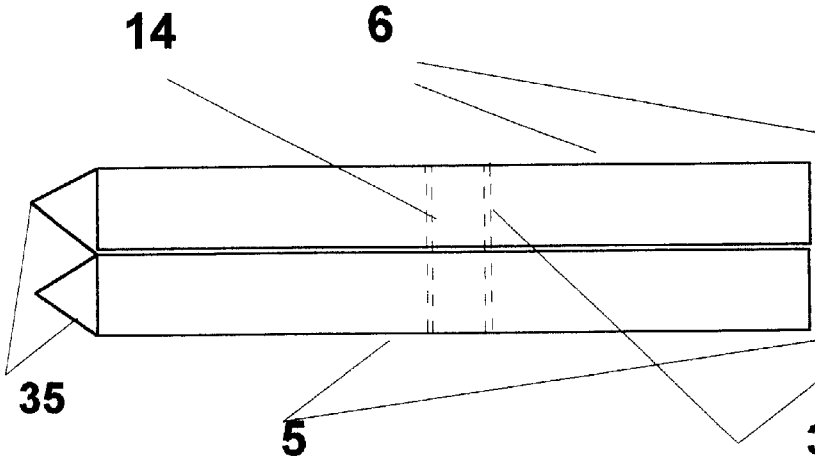
Figure 7B:
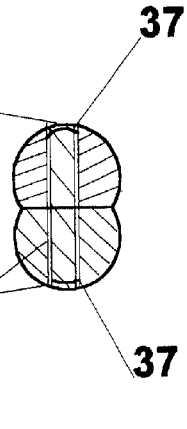

FIG. 7 sheet 6 shows a front and section of the paper clamping device.

Figure 8A:
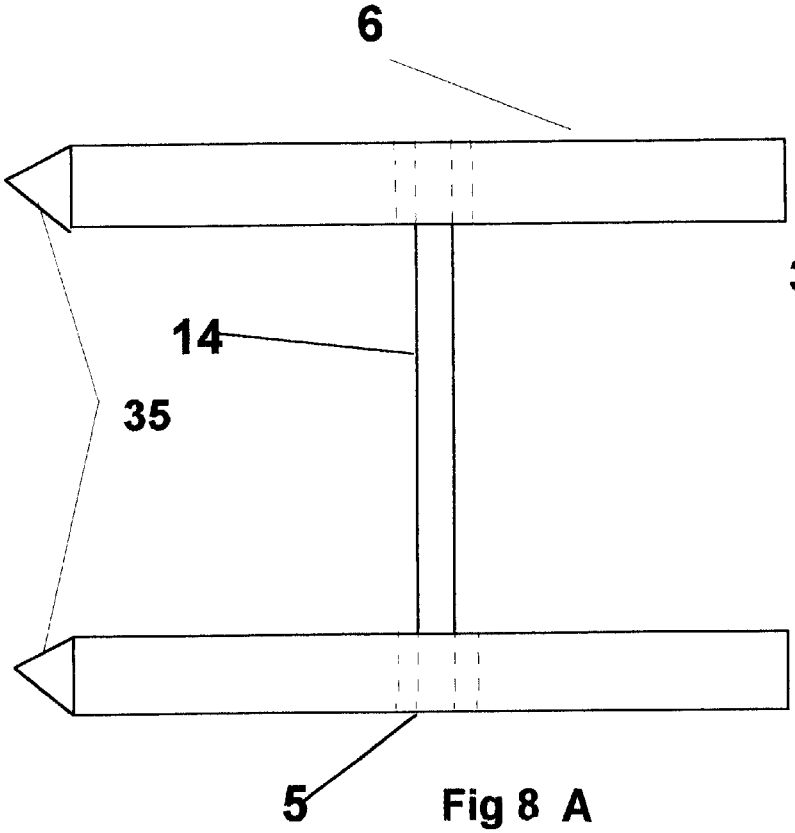
Figure 8B:
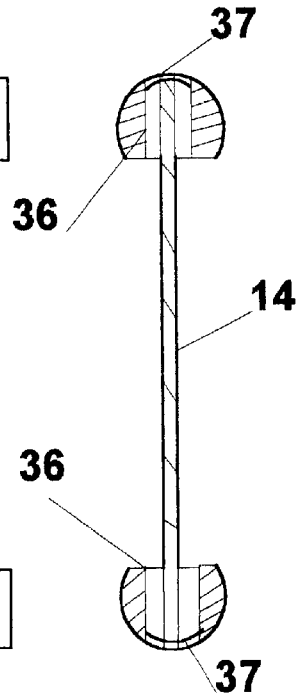

FIG. 8 sheet 6 shows a view of the paper-clamping device with elastic member extended.

Figure 9:
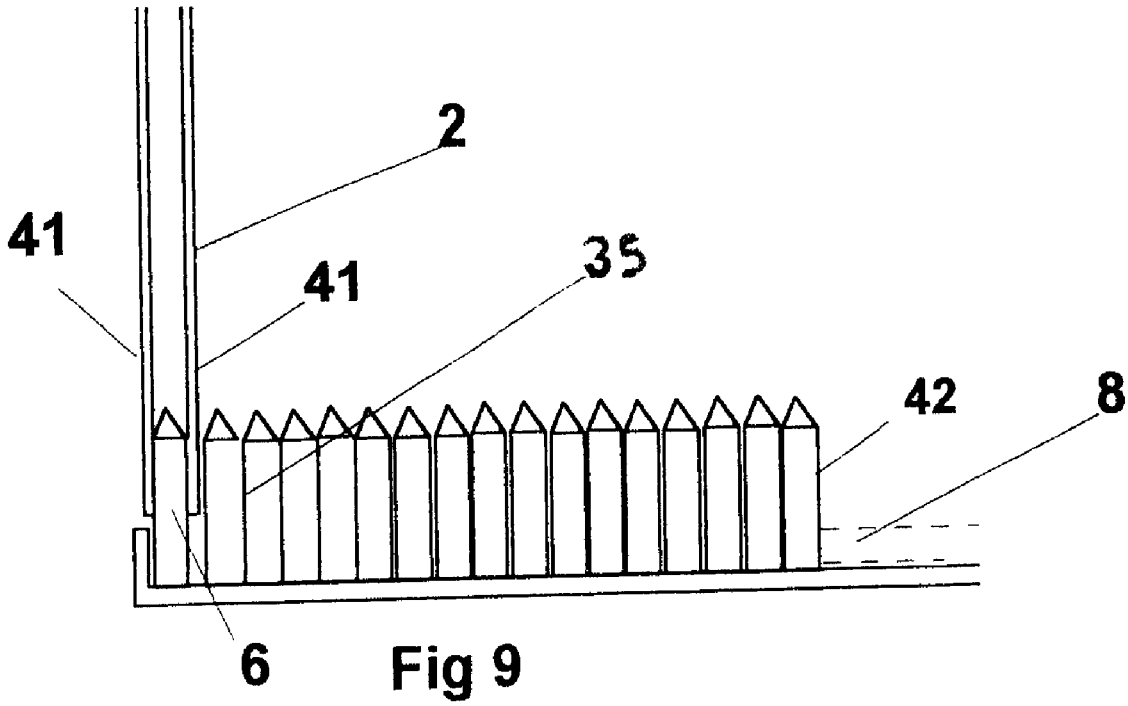

FIG. 9 sheet 7 shows a section of clamping device magazine as the punch grasps one leg of the clamping device and separates this leg from adjacent clamping device.

Figure 10:
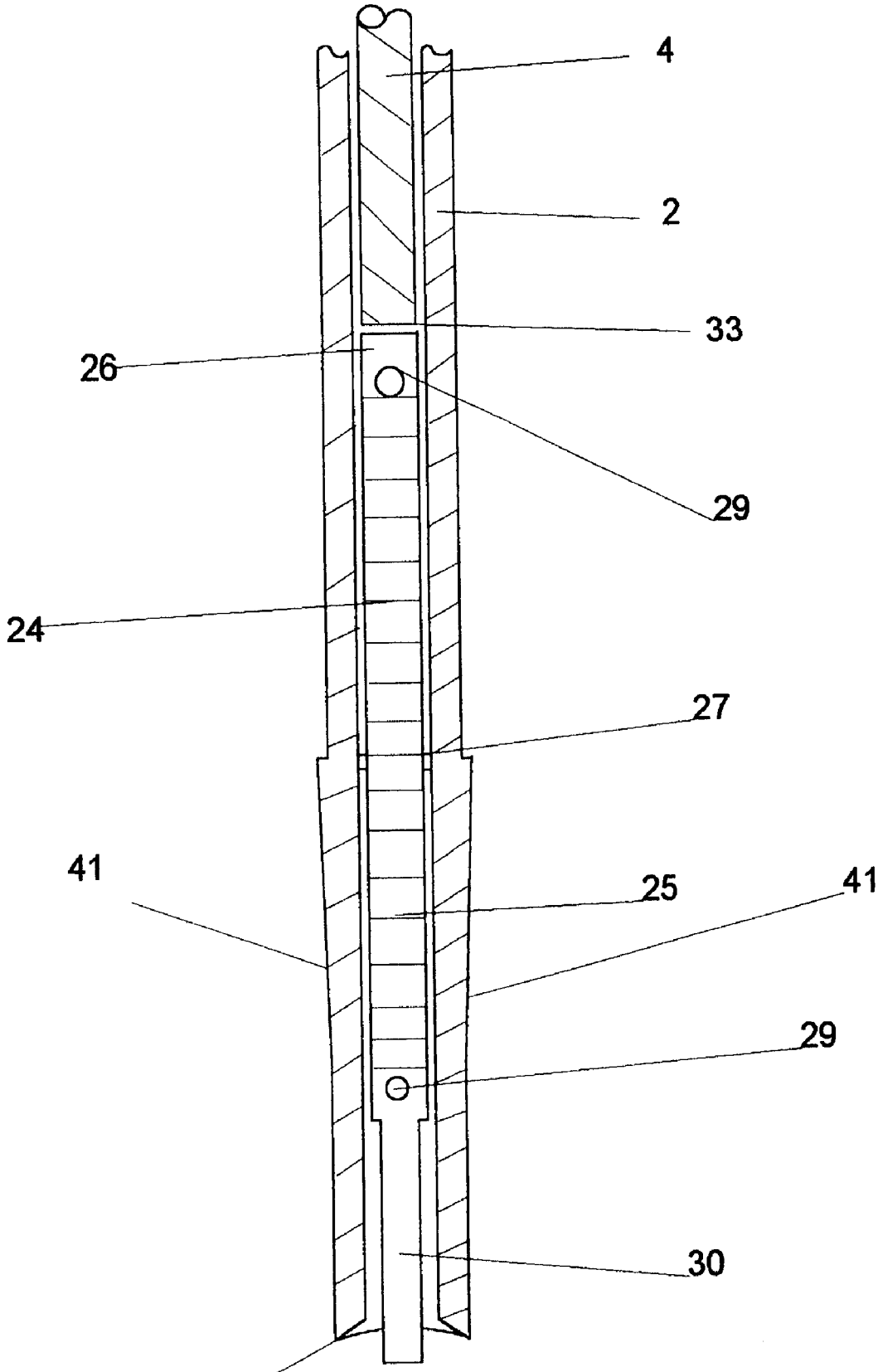

FIG. 10 sheet 8 shows an enlarged view of the ejector device, which is housed in the punch of the insertion device.

DETAILED DESCRIPTION OF THE DRAWINGS

With reference to the drawings the detail of construction of the insertion device and clamping device will be noted. With reference to FIG. 1. The insertion device is shown in side elevation. The device consists of an upper 19 support attached to a lower support 20 forming a U shaped gap into which the papers 1 to be joined are placed. The punch 2 is lowered by means of the handle 17, which slides in the shaft 50. Rotation of the shaft 50 results in the punch 2 descending vertically by means of the rack 9 and pinion 3 detailed in Sheet 2, FIG. 2. The exterior as shown in FIG. 1 also shows a housing 4 which houses the punch 2 and stopper 18 which are explained subsequently. Referring to FIG. 2 Sheet 2: which shows a side section of the insertion device: The plunger 2 punches the papers 1. The bore 21 of the punch houses an ejector spring device (enlarged view shown on FIG. 10 sheet 8) this ejects the punched piece; of paper 39 and thus prevents these 39 papers blocking the subsequent entry of the upper leg 5 of the clamping device into the lower opening of the punch 2. The ejector spring device 23 is housed in the bore of punch 2. Referring to FIG. 10 Sheet 8 the ejector device consists of a shaft 26 which has a collar 27 which slides on the shaft 26 but is attached to die bore of the punch 2. A spring located at 24 and 25 abuts against collar 27 and pins 29. The projection 30 is attached to the shaft 26 which extends beyond the end of the punch 2. When the paper is punched the projection 30 is compressed and punch 2 passes through the paper 1. When the punch 2 passes through the paper 1 the spring 25 extends and ejects the punched paper pieces 39. Referring to Sheet 2 FIG. 2: The punch now descends on upper leg 5 of the clamping device and projection 30 is compressed and friction caused by a slight taper on inside of punch 2 holds the upper leg 5 in position. The punch 2 is now extracted from the punched hole as it holds the upper leg 5. The paper 1 is now lifted by the punch 2 which is slightly tapered to increase diameter at an area 40 (FIG. 10 sheet 8) located above where punch enters the hole. At the same time the lower leg 6 is drawn through the punch hole 31 as the lower leg 6 is attached to upper leg 5 through the elastic member 14. Entry of the lower leg 6 is facilitated by the smooth surface of the conical entrance 7 to the punch hole 31. On reaching the upper support 19 the paper comes in contact with face 32 which is at a small angle the punch as seen in FIG. 5 Sheet 4. Further upward movement of upper leg 5 causes elastic member 14 to extend. Further movement again causes the ejector pin 52 to contact the surface 33 of the ejector device 23 this in turn compresses spring 24 causing projection 30 to eject the upper leg 5 of clamping device. The upper leg 5 now rotates in the area 34 and assumes a horizontal position and clamps the paper 1 as shown in FIG. 6 Sheet 5. The clamping device is shown in FIG. 7 and FIG. 8 Sheet 6. This consists of in upper leg 5 and a lower leg 6 which has one end of each upper and lower leg with a pointed end 35. The elastic member is securely attached to upper end 37 of the upper leg 5 and lower leg 6. An elastic member 14 which is housed in a cutaway portion 36 joins the upper leg 5 and lower leg 6. This cut away portion allows the elastic member 14 to expand to join a thicker bunch of papers. The clamping device can also be used manually where upper leg 5 or lower leg 6 are inserted into standard punched holes. In magazine form as shown in FIG. 9 Sheet 7 the upper leg 5 is lightly glued to adjacent upper leg 5 of the next clamping device. As the punch 2 descends it breaks the glue 53 which attaches the clamping device to its adjacent member. When loaded in the insertion device, the magazine 42 is loaded by a spring 8, which positions the next clamping device under the punch 2 for the next clamping operation. If a greater thickness of paper is required to be clamped, the blade like member 38 FIG. 3 Sheet 2 is released by removing stopper 18 and pressing knob 51 to separate the last clamping device from its adjacent glued member. This prevents spring 8 from loading next clamping device under the punch 2. This allows an increased in the thickness of the paper to be punched. When the required thickness is reached the knob 51 is withdrawn and held in place by pivoting stopper 18. The magazine 42 is then positioned for the next clamping device insertion.

What is claimed is:

1. I claim an improved paper clamping device and insertion device for retaining at least two individual sheets of paper comprising in combination a device for insertion of a clamping device consisting of an upper and a lower leg joined by a elastic member and the insertion device which punches a hole and then grasps the upper leg of the clamping device and subsequently draws the grasped upper leg through the paper sheets while positioning the lower leg parallel to the paper sheet and then releasing the grasped upper leg to secure the said sheets between the upper leg and lower leg which due to contraction of the elastic member holds the sheets securely together.

2. A clamping device as claimed in claim 1 which has upper and lower leg of size that together with elastic member will fit through the hole punched by insertion device as claimed in claim 1.

3. A clamping device as claimed in claim 1 or claim 2 where upper and lower leg of the clamping device has cut away portion on each leg to allow for extra extension of the elastic member connecting each upper and lower leg.

4. An insertion device as claimed in claim 1 that consists of a U shaped structure consisting of an upper and lower support that has on the upper support a punch operated by a lever which also has a slight increase in diameter on the said punch upper portion which will hold the sheets and lift them after the punch has penetrated the paper.

5. An upper support of insertion device as claimed in claim 1 which houses a punch as claimed in claim 4 which has a recessed portion which allows the upper leg of the clamping device to move in a horizontal direction after ejection.

6. A lower anvil support of insertion device as claimed in claim 1 which houses the punch hole has at its lower entry point a smooth conical surface to facilitate the entry of the clamping device lower leg through the punch hole.

7. A lower support area of insertion device as claimed in claim 1 which houses clamping devices aligned in sequential order in a magazine and which are positioned in the magazine by a spring-loaded member.

8. A lower support area of the insertion device as claimed in claim 1 or claimed in claim 6 which has a blade like member that prevents the loading of the clamping devices to ensure that clamping devices are not grasped by punch and to allow the inserting device to be used as a normal paper punch.

9. A punch of operated by lever as claimed in claim 4 that has a hollow bore which fits on to one of the clamping device upper leg and also houses an ejector pin and ejector mechanism which releases the clamping device upper leg when the punch reaches the upper end of its travel.

10. An ejector mechanism as claimed in claim 9 housed in the punch which by means of compressing a projection allows the paper to be punched and subsequently eject punched pieces of paper and also allowing the clamping device upper leg to be gripped by the punch and subsequently be ejected in order to then clamp the paper between the upper and lower legs.

11. An upper support of insertion device as claimed in claim 10 which has its lower surface at an angle to the punch to ensure that upper leg of clamping device after ejection by punch does not renter the punched paper hole.

* * * * *